US005595493A

United States Patent [19]

Chen

[11] Patent Number: 5,595,493

[45] Date of Patent: Jan. 21, 1997

[54] SAFETY LAMP SOCKET

[76] Inventor: Ming-Hsiung Chen, 16, Alley 3, Lane 227, Nung-An Street, Taipei, Taiwan

[21] Appl. No.: 298,331

[22] Filed: Aug. 30, 1994

[51] Int. Cl.[6] ..... H01R 29/00

[52] U.S. Cl. ..... 439/188; 200/51.09; 439/419

[58] Field of Search ..... 439/188, 419, 439/340, 414; 200/51.09

[56] References Cited

U.S. PATENT DOCUMENTS

| | | | |
|---|---|---|---|
| 3,936,122 | 2/1976 | Hagelberg | 439/188 |
| 4,222,623 | 9/1980 | Hultberg | 439/188 |
| 4,927,373 | 5/1990 | Dickie | 439/188 |
| 5,051,877 | 9/1991 | Liao | 439/419 |
| 5,389,008 | 2/1995 | Cheng et al. | 439/419 |
| 5,446,640 | 8/1995 | Lin | 439/419 |

*Primary Examiner*—Neil Abrams
*Assistant Examiner*—Barry Matthew L. Standig
*Attorney, Agent, or Firm*—Ladas & Parry

[57] ABSTRACT

A safety lamp socket including a socket body for holding a lamp bulb, a socket cap fastened to the socket body to hold down an electric wire, a center contact metal plate and a side contact metal plate fastened to said socket body and disposed in contact with the positive and negative conductors of the electric wire, a center metal spring plate and a side metal spring plate spaced inside the socket body, wherein when the lamp bulb is threaded into the socket body, the ring contact of the lamp bulb becomes fastened to the screw threads of the two mounting rods of the socket cap, the center and side metal spring plates are respectively forced by the tip and ring contacts of the lamp bulb to contact the center and side contact metal plates, causing the lamp bulb electrically connected to the electric wire.

1 Claim, 6 Drawing Sheets

SAFETY LAMP SOCKET

BACKGROUND OF THE INVENTION

The present invention relates to lamp sockets, and more particularly to a safety lamp socket which firmly holds down the lamp bulb in position when installed and, which prohibits direct contact of the fingers from the contact metal plates when the lamp bulb is removed.

Various decorative strings and Christmas tree light sets are well-known and intensively used everywhere in the world, more particularly in western countries during Christmas holidays. While using these decorative lighting devices, the requirement for a safety operation is critical. UL and CSA define strict specifications on these products.

The lamp socket for a decorative string or Christmas tree light set is generally comprised of an internally threaded plastic socket body, a plastic socket cap fastened to the socket body to hold down the electric wire, and two contact metal plates mounted within a respective hole on the socket body and disposed in contact with either conductor of the electric wire. When the lamp bulb is threaded into the socket body, the tip and ring contacts of the lamp bulb are respectively connected to the electric wire through the contact metal plates. This structure of lamp socket is functional however, it has drawbacks. One drawback of this structure of lamp socket is that the inner thread of the plastic socket body doesn't firmly match the ring contact of the lamp bulb, and the socket body may expand when hot, causing the lamp bulb disconnected from the socket body. Another drawback of this structure of lamp socket is that the contact metal plates may be touched by the fingers when the lamp bulb is removed, causing an electric shock.

SUMMARY OF THE INVENTION

The present invention has been accomplished to provide a safety socket lamp which eliminates the aforesaid drawbacks. According to one aspect of the present invention, the two mounting rods of the socket cap are made with a respective screw thread such that the ring contact of the lamp bulb becomes firmly retained to the screw thread portions of the mounting rods of the socket cap when the lamp bulb is threaded into the socket body. According to another aspect of the present invention, a center metal spring plate and a side metal spring plate are respectively disposed inside the socket body and spaced from the center and side contact metal plates. When the lamp bulb is threaded into the socket body, the center metal spring plate is forced upwards by the tip contact of the lamp bulb to contact the center contact 5 metal plate and the side metal spring plate is forced sideways by the ring contact of the lamp bulb to contact the side contact metal plate, and therefore the lamp bulb becomes electrically connected to the electric wire. When the lamp bulb is removed from the socket 10 body, the center and side metal spring plates automatically return to their former shapes. Therefore, no electric shock will happen when the fingers are inserted into the socket body after the lamp bulb was removed.

DETAILED DESCRIPTION OF THE PREFERRED EMBODIMENT

Figure 1:
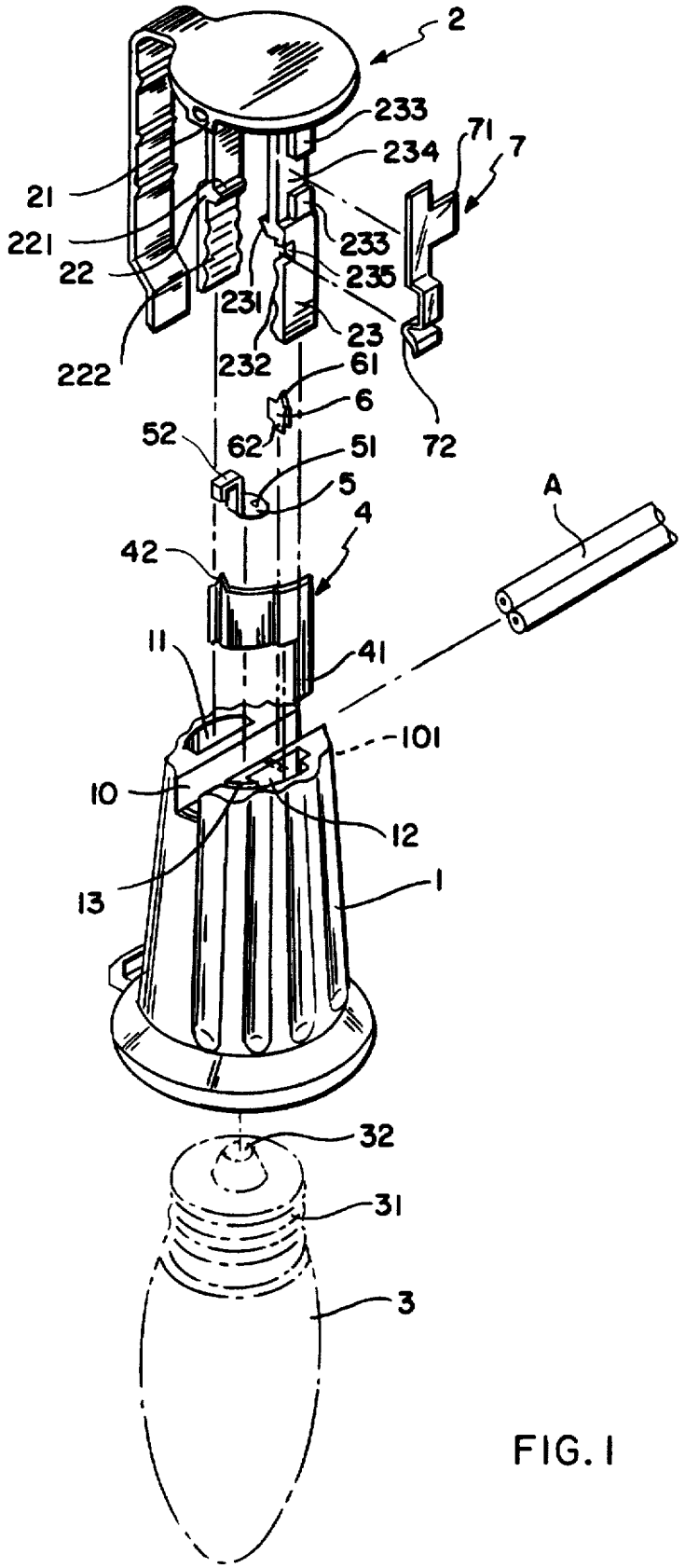
FIG. 1 is an exploded view of a safety lamp socket according to one embodiment of the present invention.
Figure 2:
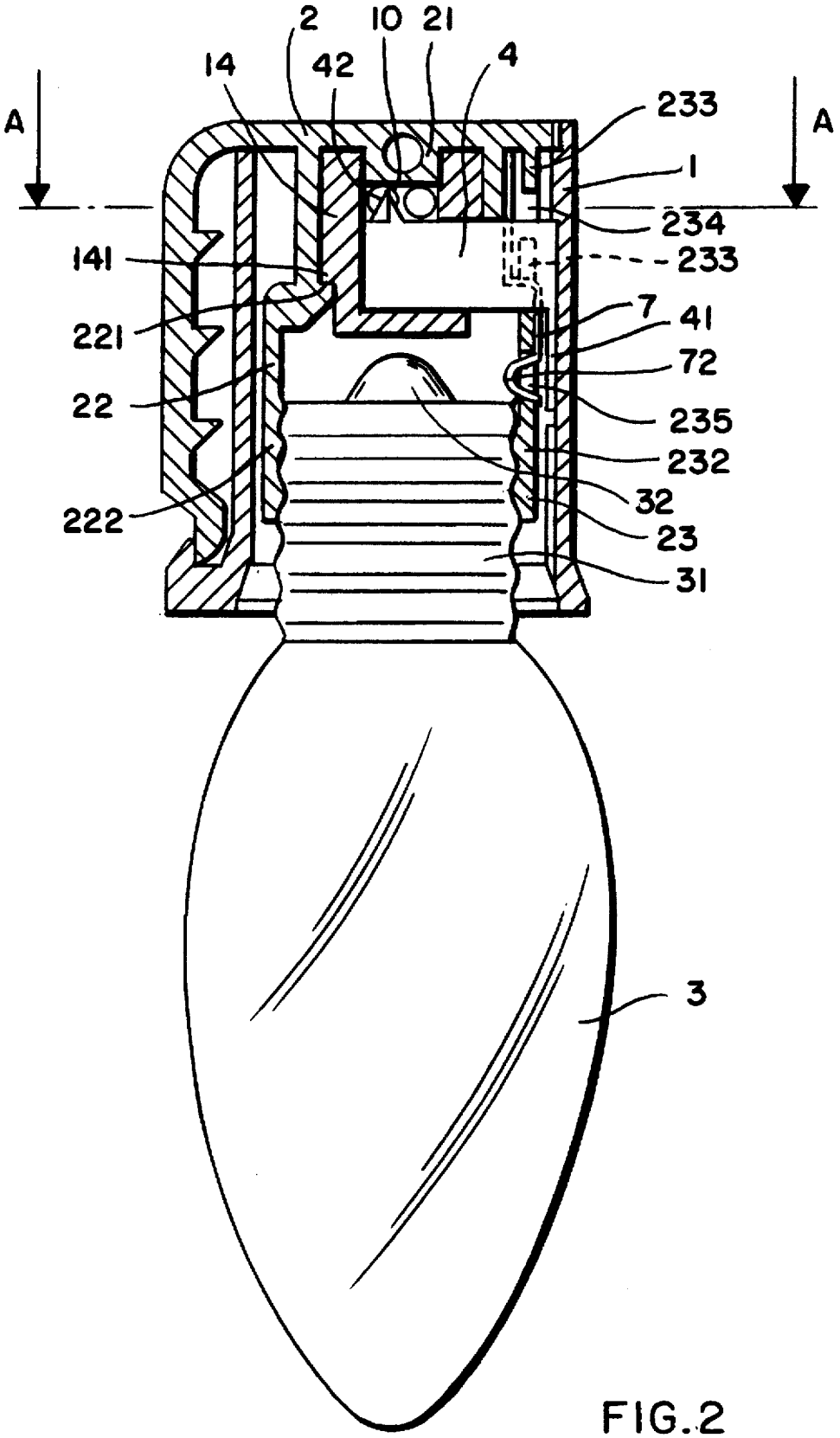
FIG. 2 is a longitudinal view in section of the lamp socket shown in FIG. 1 (before the connection of the side contact metal plate and the side metal spring plate)
Figure 3:
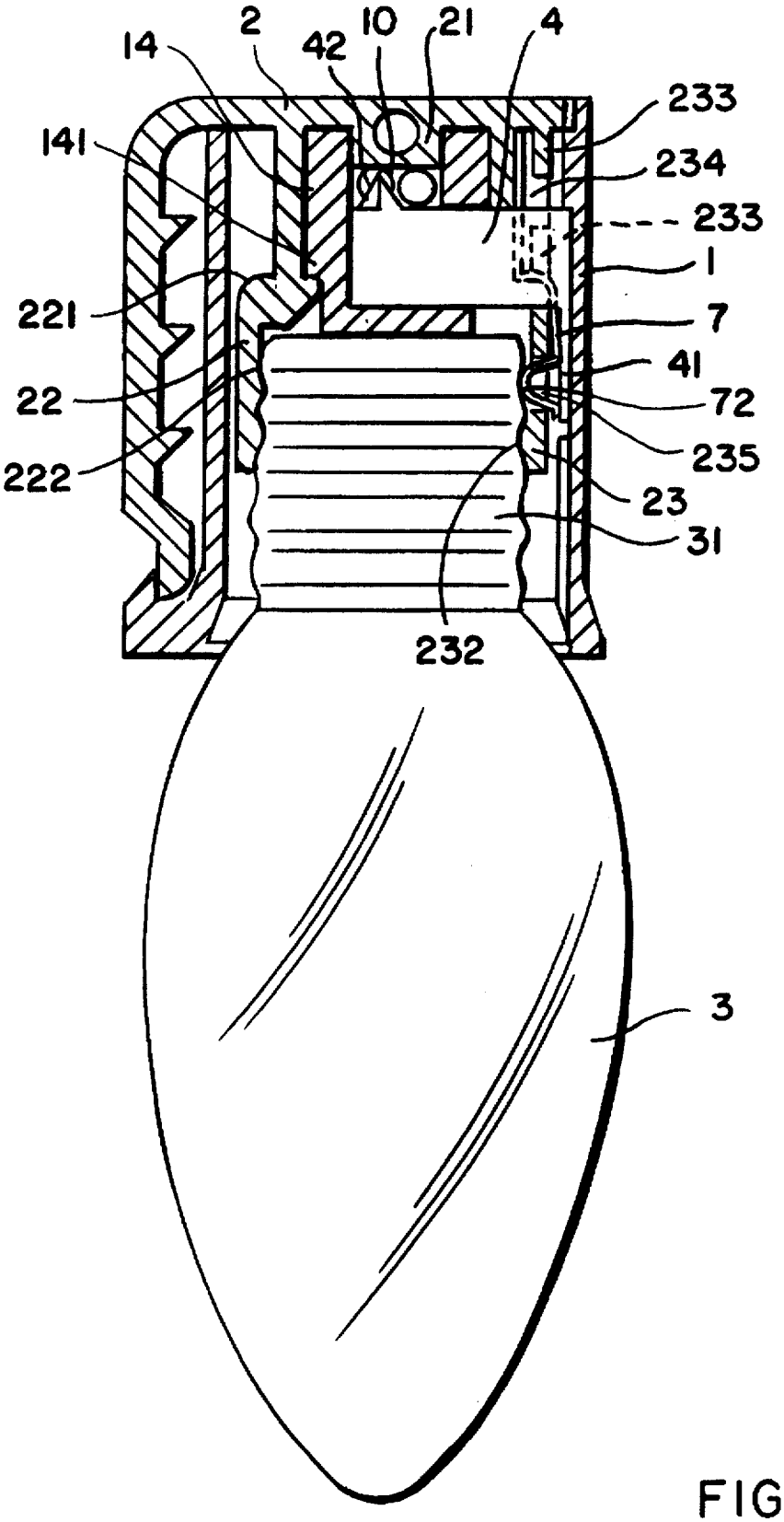
FIG. 3 shows the lamp bulb threaded into position of the socket body of the lamp socket of FIG. 2, showing the side contact metal plate and the side metal spring plate electrically connected.

Referring to FIGS. 1 and 2, a safety lamp socket in accordance with the present invention is generally comprised of socket body 1, a socket cap 2 fastened to the socket body 1 at one end.

Figure 4:
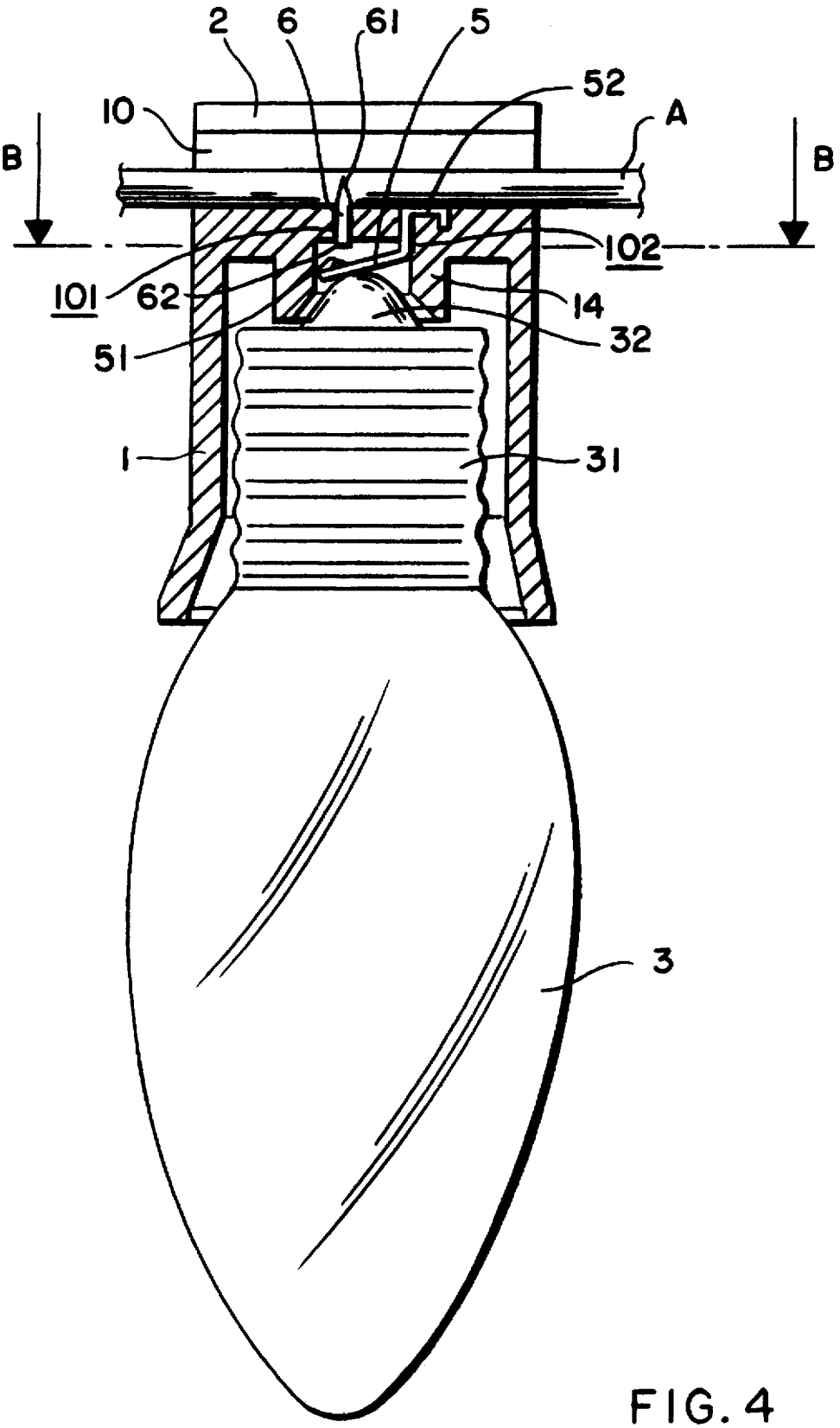
FIG. 4 is similar to FIG. 2 but taken from another direction (before the connection of the center contact metal plate and the center metal spring plate)
Figure 5:
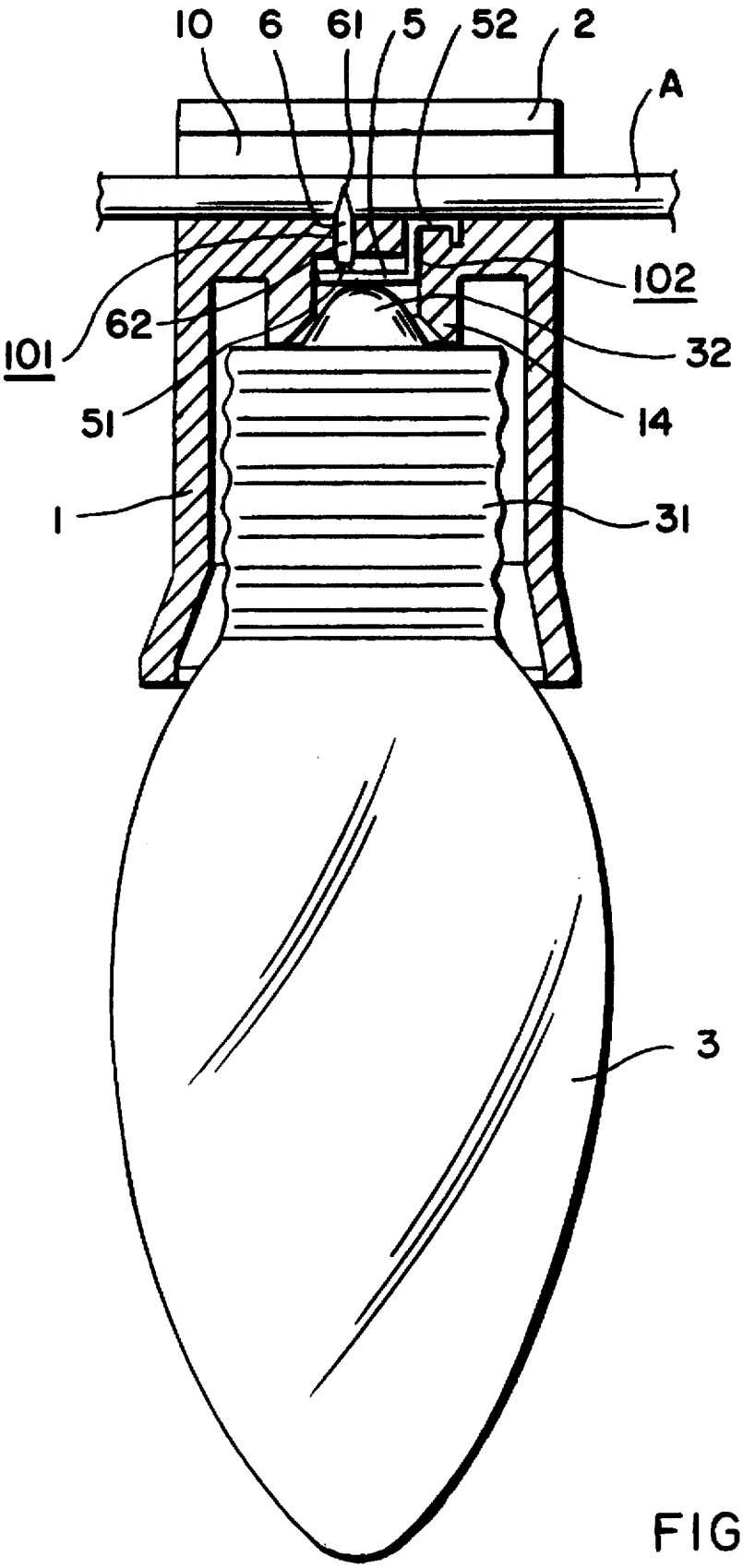
FIG. 5 is similar to FIG. 4 but showing the center contact metal plate and the center metal spring plate electrically connected.
Figure 6:
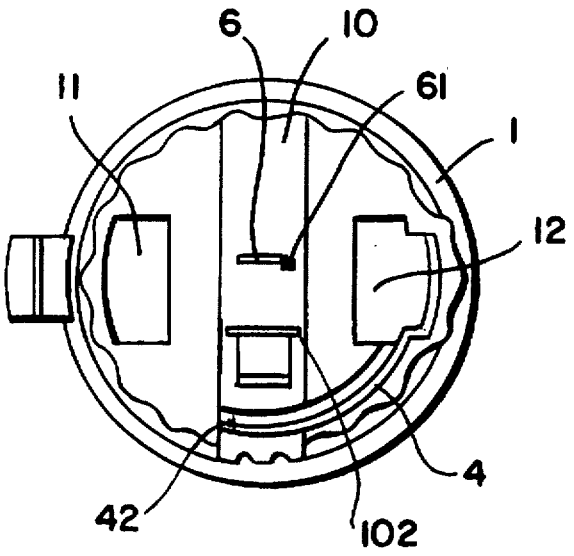
FIG. 6 is a cross section taken along line A—A of FIG. 2.
Figure 7:
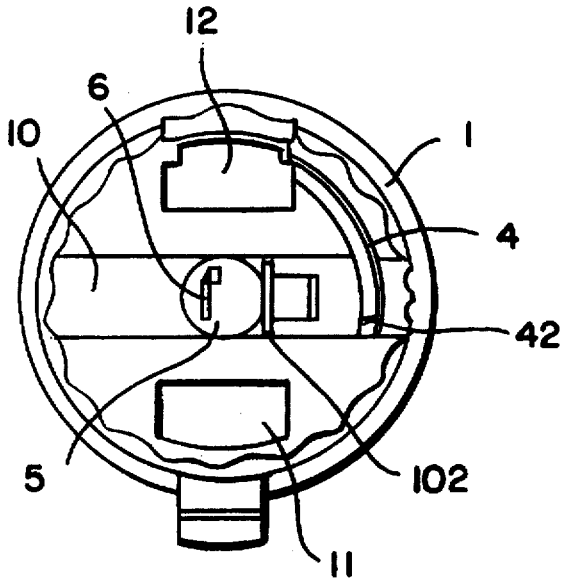
FIG. 7 is a cross section taken along line B—B of FIG. 4.

The socket body 1 comprises an elongated top recess 10 at the top for receiving the electric wire A, two slots 11 and 12 disposed at two opposite sides by the top recess 10, a center through hole 101 through the top recess 10 at the center, a retaining hole 102 disposed adjacent to the center through hole 101, and an arched through hole 13 adjacent to the right-sided slot 12. A center contact metal plate 6 is received in the center through hole 101, having a beveled top edge 61, which pierces the insulator of the electric wire A to make an electric contact, and a bottom contact end 62 projecting into the inside space of the socket body 1. A center metal spring plate 5 is provided having a retainer portion 52 hooked in the retaining hole 102 and a raised portion 51 suspended right below the bottom contact end 62 of the center contact metal plate 6 (see FIGS. 4, 5 and 7). A side contact metal plate 4 is fastened to the arched through hole 13, having a downward leg 41 at one side and an upward tip 42 at an opposite side (see FIGS. 1, 2 and 6). When installed, the upward tip 42 pierces the insulator of the electric wire A to make an electric contact.

The socket cap 2 comprises a press block 21 inserted into the top recess 10 to hold down the electric wire A, a first mounting rod 22 and a second mounting rod 23 bilaterally disposed at the bottom and respectively inserted into the slots 11 and 12. The mounting rod 22 or 23 has a screw thread lower section 222 or 232 for fastening the ring contact 31 of the lamp bulb 3, and a hooked portion 221 or 231 transversely disposed in the middle at an inner side. The second mounting rod 23 further comprises two vertically spaced projecting blocks 233 at an outer side defining a T-groove 234, and a notch 235 on the screw thread lower section 232 adjacent to the hooked portion 231. A side metal spring plate 7 is provided having a T-shaped top mounting section 71 fitted into the T-groove 234 on the second mounting rod 23, and a curved bottom section 72 protruding over the notch 235 on the second mounting rod 23.

When the electric wire A is arranged within the top recess 10, the mounting rods 22 and 23 of the socket cap 2 are respectively inserted into the slots 11 and 12 permitting the hooked portions 221 and 231 to hook the inside wall of the socket body 1. When the socket cap 2 and the socket body 1 are fastened together, the press block 21 holds down the electric wire A causing the beveled top edge 61 of the center contact metal plate 6 and the tip 42 of the side contact metal plate 4 pierced the insulator of the electric wire A to make a respective electric contact.

Referring to FIGS. 2, 3, 4, and 5, when the ring contact 31 of the lamp bulb 3 is threaded into the socket body 1, it becomes fastened to the screw thread lower sections 222 and 232 of the mounting rods 22 and 23 of the socket cap 2 and firmly retained in position. At the same time the curved bottom section 72 of the side metal spring plate 7 is forced outwards by the ring contact 31 of the lamp bulb 3 to contact the leg 41 of the side contact metal plate 4, and the raised portion 51 of the center metal spring plate 5 is moved upwards by the tip contact 32 of the lamp bulb 3 to contact the bottom contact end 62 of the center contact metal plate 6, and therefore the lamp bulb 3 is electrically connected to give light.

What is claimed is:

1. A safety lamp socket of the type comprising a socket body having a top recess and two opposite mounting slots and two contact metal plate mounting holes, an electric wire arranged within said top recess, a socket cap having two mounting rods fastened to said mounting slots and a press block pressed on said electric wire, a center contact metal plate and a side contact metal plate respectively fastened to said contact metal plate mounting holes and disposed in contact with the positive and negative conductors of said electric wire, wherein:

said two mounting rods of said socket cap each have a hooked portion hooked on said mounting holes on the inside and a screw thread lower section for fastening a ring contact of a lamp bulb being threaded into said socket body, one mounting rod having a T-groove at an outer side and a notch on the respective screw thread lower portion; said side contact metal plate has a contact leg suspending inside said socket body; a side metal spring plate is disposed inside said socket body, having a T-shaped top mounting section fitted into said T-groove and a curved bottom section protruding over said notch, the curved bottom section of said side metal spring plate being forced by the ring contact of said lamp bulb to contact the contact leg of said side contact metal plate when said lamp bulb is threaded into said socket body; a center metal spring plate is disposed between said mounting rods of said socket cap inside said socket body, having a retaining portion fastened to a retaining hole inside said socket body and a raised portion spaced from said center contact metal plate, said raised portion being forced by the tip contact of said lamp bulb to contact said center contact metal plate when said lamp bulb is threaded into said socket body.

* * * * *